US010500120B2

(12) United States Patent
Sugihara et al.

(10) Patent No.: US 10,500,120 B2
(45) Date of Patent: Dec. 10, 2019

(54) UPPER-LIMB REHABILITATION ASSISTING DEVICE AND METHOD FOR CONTROLLING THE SAME

(71) Applicants: TOYOTA JIDOSHA KABUSHIKI KAISHA, Toyota-shi, Aichi-ken (JP); RIKEN, Wako-shi, Saitama (JP)

(72) Inventors: Hisayoshi Sugihara, Aichi-ken (JP); Hitoshi Yamada, Nagakute (JP); Takashi Izuo, Toyota (JP); Masashi Yamashita, Miyoshi (JP); Keiichi Kitajo, Tokyo (JP); Shingo Shimoda, Kasugai (JP)

(73) Assignees: TOYOTA JIDOSHA KABUSHIKI KAISHA, Aichi-ken (JP); RIKEN, Wako-shi, Saitama (JP)

( * ) Notice: Subject to any disclaimer, the term of this patent is extended or adjusted under 35 U.S.C. 154(b) by 283 days.

(21) Appl. No.: 15/490,221

(22) Filed: Apr. 18, 2017

(65) Prior Publication Data

US 2017/0304137 A1 Oct. 26, 2017

(30) Foreign Application Priority Data

Apr. 22, 2016 (JP) ..... 2016-086111

(51) Int. Cl.
*A61H 1/02* (2006.01)
*A63B 21/22* (2006.01)
(Continued)

(52) U.S. Cl.
CPC ..... *A61H 1/0274* (2013.01); *A63B 21/0058* (2013.01); *A63B 21/00178* (2013.01);
(Continued)

(58) Field of Classification Search
CPC .. A61H 1/0274; A61H 1/0237; A61H 1/0214; A61H 1/008; A61H 1/0285;
(Continued)

(56) References Cited

U.S. PATENT DOCUMENTS 7,821,407 B2 * 10/2010 Shears ..... A61B 5/1127 340/573.1
8,012,107 B2 * 9/2011 Einav ..... A61B 34/30 601/5
(Continued)

FOREIGN PATENT DOCUMENTS

JP 2010-201111 A 9/2010
JP 2012-035022 A 2/2012
(Continued)

*Primary Examiner* — Alvin J Stewart
(74) *Attorney, Agent, or Firm* — Sughrue Mion, PLLC

(57) ABSTRACT

An upper-limb rehabilitation assisting device includes first and second handles coupled to first and second rotating shafts and rotationally operated by hands on a paralytic limb side and a healthy limb side; first and second biosignal detecting parts that detect first and second biosignals corresponding to the paralytic limb side and the healthy limb side; first and second drive parts that drive the first and second rotating shafts; and a control part that performs a cooperative control of the first rotating shaft and the second rotating shaft. The control part controls the torques of the first and second drive parts at the time of the cooperative control of the first and second rotating shafts the basis of the degree of cooperation between the first and second biosignals.

6 Claims, 6 Drawing Sheets

(51) Int. Cl.

| | |
|---|---|
| ***A63B 21/00*** | (2006.01) |
| ***A63B 23/12*** | (2006.01) |
| ***A63B 24/00*** | (2006.01) |
| ***A63B 71/06*** | (2006.01) |
| ***A63B 21/005*** | (2006.01) |
| *A63B 22/00* | (2006.01) |

(52) U.S. Cl.

CPC ..... *A63B 21/00181* (2013.01); *A63B 21/222* (2015.10); *A63B 21/4035* (2015.10); *A63B 21/4049* (2015.10); *A63B 23/12* (2013.01); *A63B 24/0087* (2013.01); *A63B 71/0622* (2013.01); *A61H 2201/0138* (2013.01); *A61H 2201/0161* (2013.01); *A61H 2201/0192* (2013.01); *A61H 2201/1207* (2013.01); *A61H 2201/1276* (2013.01); *A61H 2201/1635* (2013.01); *A61H 2201/1671* (2013.01); *A61H 2201/5007* (2013.01); *A61H 2201/5043* (2013.01); *A61H 2201/5058* (2013.01); *A61H 2201/5097* (2013.01); *A61H 2205/06* (2013.01); *A61H 2230/085* (2013.01); *A61H 2230/105* (2013.01); *A61H 2230/605* (2013.01); *A63B 23/1245* (2013.01); *A63B 2022/0094* (2013.01); *A63B 2024/0093* (2013.01); *A63B 2071/0638* (2013.01); *A63B 2210/50* (2013.01); *A63B 2220/24* (2013.01); *A63B 2220/54* (2013.01); *A63B 2225/09* (2013.01); *A63B 2225/093* (2013.01); *A63B 2225/50* (2013.01); *A63B 2230/10* (2013.01); *A63B 2230/605* (2013.01)

(58) Field of Classification Search

CPC ..... A61H 2201/123; A61H 2201/1207; A63B 21/4029; A63B 21/4033; A63B 22/0017; A63B 24/00; A63B 24/0087; A63B 22/0694; A63B 23/02; A61B 34/30; A61B 5/1124

See application file for complete search history.

(56) References Cited

U.S. PATENT DOCUMENTS

| | | | | |
|---|---|---|---|---|
| 9,847,045 | B2 * | 12/2017 | Campolo | A61H 1/0274 |
| 10,018,298 | B2 * | 7/2018 | Goldish | F16M 11/42 |
| 10,112,066 | B2 * | 10/2018 | Heathfield | A63B 21/00069 |
| 10,293,199 | B2 * | 5/2019 | Roh | A61H 1/008 |
| 10,299,979 | B2 * | 5/2019 | Sapin | A61H 1/0274 |
| 2002/0094913 | A1 * | 7/2002 | Valentino | A61H 1/0285 482/45 |
| 2007/0282228 | A1 * | 12/2007 | Einav | A63B 21/4021 601/33 |
| 2007/0299371 | A1 * | 12/2007 | Einav | A61B 34/30 601/5 |
| 2008/0071199 | A1 * | 3/2008 | Wu | A61H 1/0214 601/23 |
| 2010/0130893 | A1 * | 5/2010 | Sankai | A63B 21/4047 601/5 |
| 2011/0300994 | A1 * | 12/2011 | Verkaaik | A61H 1/0274 482/51 |
| 2012/0029391 | A1 * | 2/2012 | Sung | A61B 5/1121 600/595 |
| 2015/0302777 | A1 * | 10/2015 | Campolo | A61H 1/0274 434/262 |
| 2016/0029928 | A1 * | 2/2016 | Jang | A61H 1/0244 600/595 |
| 2016/0038075 | A1 * | 2/2016 | Burdea | A61B 5/4088 434/258 |
| 2017/0095391 | A1 * | 4/2017 | Sapin | A61H 1/0274 |
| 2017/0340502 | A1 * | 11/2017 | Roh | A61H 1/008 |
| 2018/0154204 | A1 * | 6/2018 | Bayerlein | A63B 71/0622 |
| 2018/0228682 | A1 * | 8/2018 | Bayerlein | A61H 1/0214 |
| 2018/0304113 | A1 * | 10/2018 | Goldish | A63B 71/0054 |
| 2019/0020530 | A1 * | 1/2019 | Au | H04W 72/0413 |
| 2019/0021929 | A1 * | 1/2019 | Einav | A61B 34/30 |
| 2019/0038930 | A1 * | 2/2019 | Sugihara | A61H 1/0274 |
| 2019/0091506 | A1 * | 3/2019 | Gatelli | A61H 1/0237 |

FOREIGN PATENT DOCUMENTS

| | | |
|---|---|---|
| JP | 2017113409 A | 6/2017 |
| WO | 2017109564 A1 | 6/2017 |

* cited by examiner

UPPER-LIMB REHABILITATION ASSISTING DEVICE AND METHOD FOR CONTROLLING THE SAME

INCORPORATION BY REFERENCE

The disclosure of Japanese Patent Application No. 2016-086111 filed on Apr. 22, 2016 including the specification, drawings and abstract is incorporated herein by reference in its entirety.

BACKGROUND

1. Technical Field

The present disclosure relates to an upper-limb rehabilitation assisting device and a method for controlling the same that assist in rehabilitation of a trainee's upper limbs.

2. Description of Related Art

An upper-limb rehabilitation assisting device including a pair of stages configured to be movable from front to back and from side to side on a horizontal plane and located at positions bilaterally mirror-symmetrical to each other, and forearm wrist joint movement assisting parts fixed to the stages, respectively, is known (refer to Japanese Patent Application Publication No. 2010-201111 (JP 2010-201111 A).

SUMMARY

In the above upper-limb rehabilitation assisting device, the pair of stages moves in a bilaterally mirror-symmetrical manner. Therefore, the movement of a paralytic-limb-side arm depends on the movement of a healthy-limb-side arm, it becomes difficult to move the paralytic-limb-side arm actively.

The disclosure provides an upper-limb rehabilitation assisting device and a method for controlling the same that can move a paralytic-limb-side arm actively and easily because an assisting force for the movement of the paralytic-limb-side arm can be adjusted according to the degree of paralysis of the paralytic-limb-side arm.

A first aspect of the disclosure is an upper-limb rehabilitation assisting device including a first handle coupled to a first rotating shaft rotatably provided such that a rotational direction includes a component in a gravitational direction and gripped and rotationally operated by a hand on a paralytic limb side of a trainee; a second handle coupled to a second rotating shaft rotatably provided such that a rotational direction includes the component in the gravitational direction and gripped and rotationally operated by a hand on a healthy limb side of the trainee; a first biosignal detecting part configured to detect a first biosignal corresponding to the paralytic limb side of the trainee; a second biosignal detecting part configured to detect a second biosignal corresponding to the healthy limb side of the trainee; a first drive part configured to drive the first rotating shaft on the paralytic limb side; a second drive part configured to drive the second rotating shaft on the healthy limb side; a first torque detecting part configured to detect a first rotary torque of the first rotating shaft on the paralytic limb side; a second torque detecting part configured to detect a second rotary torque of the second rotating shaft on the healthy limb side; a first rotational angle detecting part configured to detect a first rotational angle of the first rotating shaft on the paralytic limb side; a second rotational angle detecting part configured to detect a second rotational angle of the second rotating shaft on the healthy limb side; and a control part configured to perform a cooperative control of the first rotating shaft and the second rotating shaft in which a second target rotational angle of the second rotating shaft is calculated on a basis of the first rotary torque detected by the first torque detecting part and the second drive part is controlled such that the second rotational angle detected by the second rotational angle detecting part becomes the second target rotational angle and in which a first target rotational angle of the first rotating shaft is calculated on a basis of the second rotary torque detected by the second torque detecting part and the first drive part is controlled such that the first rotational angle detected by the first rotational angle detecting part becomes the first target rotational angle. The control part calculates a degree of cooperation between the first biosignal detected by the first biosignal detecting part and the second biosignal detected by the second biosignal detecting part, and controls torques of the first drive part and the second drive part at a time of the cooperative control of the first rotating shaft and the second rotating shaft, based on the degree of cooperation. In this first aspect, the control part may calculate the second target rotational angle of the second rotating shaft based on a first relational expression among the first rotary torque detected by the first torque detecting part and a rotational angle of the second rotating shaft, the first relational expression including a first predetermined spring constant, may calculate the first target rotational angle of the first rotating shaft based on a second relational expression among the second rotary torque detected by the second torque detecting part and a rotational angle of the first rotating shaft, the second relational expression including a second predetermined spring constant, and may reduce the torques of the first drive part and the second drive part at the time of the cooperative control of the first rotating shaft and the second rotating shaft by reducing the first predetermined spring constant and the second predetermined spring constant. In this first aspect, the first biosignal detecting part may detect a first myoelectricity of an arm on the paralytic side of the trainee as the first biosignal corresponding to the paralytic limb side, the second biosignal detecting part may detect a second myoelectricity of an arm on the healthy side of the trainee as the second biosignal corresponding to the healthy limb side, and the control part may calculate a degree of similarity between the first myoelectricity detected by the first biosignal detecting part and the second myoelectricity detected by the second biosignal detecting part, and may control the torques of the first drive part and the second drive part at the time of the cooperative control of the first rotating shaft and the second rotating shaft based on the degree of similarity. In this first aspect, the first biosignal detecting part may detect a first brain-wave signal from the vicinity of a motor area on a brain hemisphere corresponding to the paralytic side of the trainee, as the first biosignal corresponding to the paralytic limb side, the second biosignal detecting part may detect a second brain-wave signal from the vicinity of a motor area on a brain hemisphere corresponding to the healthy side of the trainee, as the second biosignal corresponding to the healthy limb side, and the control part may calculate a degree of phase synchronization between a first instantaneous phase specified from the first brain-wave signal and a second instantaneous phase specified from the second brain-wave signal, and may control the torques of the first drive part and the second drive part at the time of the cooperative control of the first rotating shaft and the second rotating shaft based on the degree of phase synchronization. A second aspect of the disclosure related to a method for controlling an upper-limb rehabilitation assisting device including a first handle coupled to a first rotating shaft rotatably provided such that a rotational direction includes a component in a gravitational direction and gripped and rotationally operated by a hand on a paralytic limb side of a trainee, and a second handle coupled to a second rotating shaft rotatably provided such that a rotational direction includes the component in the gravitational direction and gripped and rotationally operated by a hand on a healthy limb side of the trainee. The second aspect of the disclosure includes detecting a first biosignal corresponding to the paralytic limb side of the trainee; detecting a second biosignal corresponding to the healthy limb side of the trainee; detecting a first rotary torque of the first rotating shaft on the paralytic limb side; detecting a second rotary torque of the second rotating shaft on the healthy limb side; detecting a first rotational angle of the first rotating shaft on the paralytic limb side; detecting a second rotational angle of the second rotating shaft on the healthy limb side; performing a cooperative control of the first rotating shaft and the second rotating shaft in which a second target rotational angle of the second rotating shaft is calculated on a basis of the first rotary torque and the second rotating shaft is controlled such that the second rotational angle becomes the second target rotational angle and in which a first target rotational angle of the first rotating shaft is calculated on a basis of the second rotary torque and the first rotating shaft is controlled such that the first rotational angle becomes the first target rotational angle; calculating a degree of cooperation between the first biosignal and the second biosignal; and controlling drive torques at a time of the cooperative control of the first rotating shaft and the second rotating shaft, based on the degree of cooperation. A third aspect of the disclosure is an upper-limb rehabilitation assisting device including a first handle coupled to a first rotating shaft rotatably provided such that a rotational direction includes a component in a gravitational direction and gripped and rotationally operated by a hand on a paralytic limb side of a trainee; a second handle coupled to a second rotating shaft rotatably provided such that a rotational direction includes the component in the gravitational direction and gripped and rotationally operated by a hand on a healthy limb side of the trainee; a first drive part configured to drive the first rotating shaft on the paralytic limb side; a second drive part configured to drive the second rotating shaft on the healthy limb side; a first torque detecting part configured to detect a first rotary torque of the first rotating shaft on the paralytic limb side; a second torque detecting part configured to detect a second rotary torque of the second rotating shaft on the healthy limb side; a first rotational angle detecting part configured to detect a first rotational angle of the first rotating shaft on the paralytic limb side; a second rotational angle detecting part configured to detect a second rotational angle of the second rotating shaft on the healthy limb side; and a control part configured to perform a cooperative control of the first rotating shaft and the second rotating shaft in which a second target rotational angle of the second rotating shaft is calculated on a basis of the first rotary torque detected by the first torque detecting part and the second drive part is controlled such that the second rotational angle detected by the second rotational angle detecting part becomes the second target rotational angle and in which a first target rotational angle of the first rotating shaft is calculated on a basis of the second rotary torque detected by the second torque detecting part and the first drive part is controlled such that the first rotational angle detected by the first rotational angle detecting part becomes the first target rotational angle. The control part moves a target with respect to a predetermined track in a virtual space according to the first rotational angle detected by the first rotational angle detecting part, calculates a deviation between a track of the target calculated on a basis of the first rotational angle, and the predetermined track, and reduces torques of the first drive part and the second drive part at a time of the cooperative control as the deviation decreases.

The disclosure provides the upper-limb rehabilitation assisting device and the method for controlling the same that can move the paralytic-limb-side arm actively and easily because the assisting force for the movement of the paralytic-limb-side arm can be adjusted according to the degree of paralysis of the paralytic-limb-side arm.

BRIEF DESCRIPTION OF THE DRAWINGS

Features, advantages, and technical and industrial significance of exemplary embodiments will be described below with reference to the accompanying drawings, in which like numerals denote like elements, and wherein.

DETAILED DESCRIPTION OF EMBODIMENTS

Embodiment 1

Hereinafter, embodiments of the disclosure will be described with reference to the drawings. An upper-limb rehabilitation assisting device related to a first embodiment of the disclosure is, for example, a device that assists in rehabilitation training for recovering the movement of the upper limbs of trainees, such as patients, whose upper limbs have suffered unilateral paralysis due to brain diseases, such as apoplexy.

Figure 1:
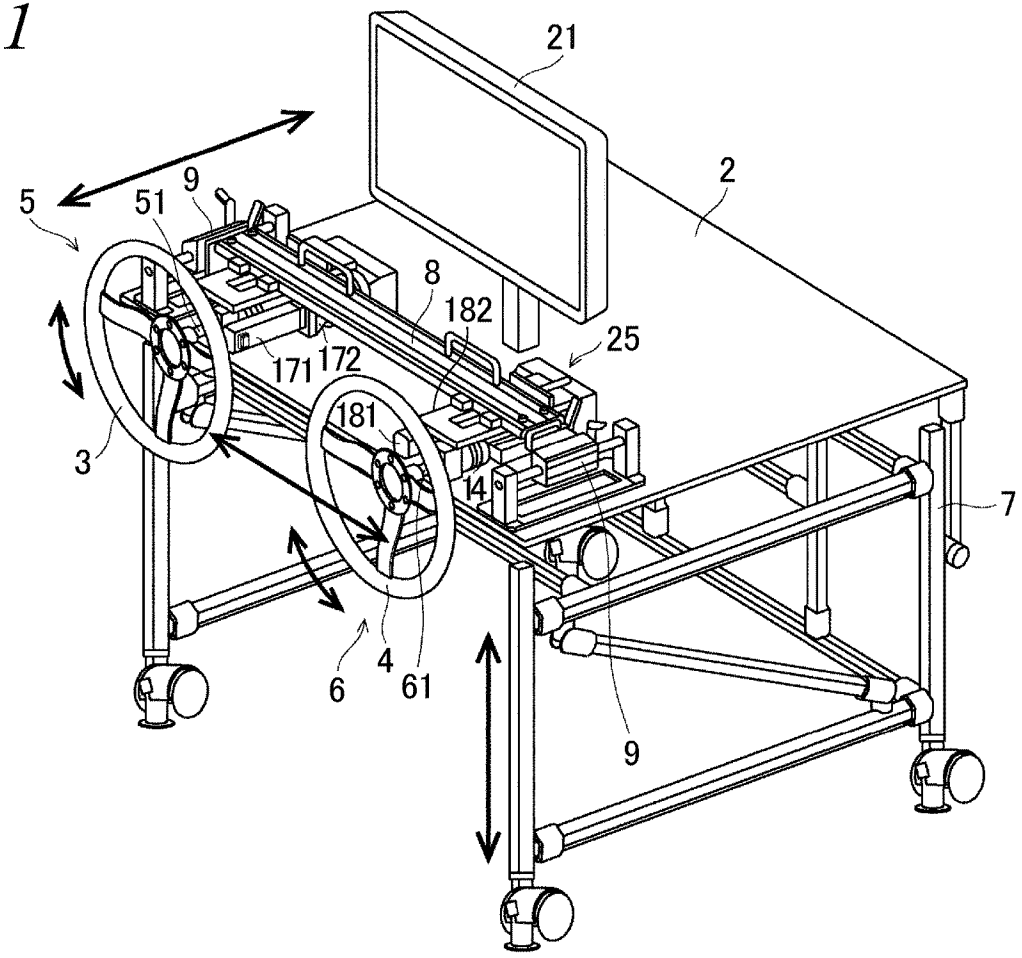
FIG. 1 is a perspective view illustrating a schematic configuration of an upper-limb rehabilitation assisting device related to a first embodiment.

FIG. 1 is a perspective view illustrating a schematic configuration of the upper-limb rehabilitation assisting device related to the first embodiment of the disclosure. The upper-limb rehabilitation assisting device 1 related to the first embodiment includes a foundation part 2, and first and second rotating mechanisms 5, 6 that are provided on the foundation part 2 and rotate the first and second handles 3, 4 to be gripped by a trainee's hands and rotationally operated, respectively.

The first rotating mechanism 5 is provided on a left side of the foundation part 2 as viewed from the trainee. The first rotating mechanism 5 has a first handle 3 to be gripped by a trainee's left hand and rotationally operated, and a first rotating shaft 51 having one end coupled to the first handle 3. The first rotating shaft 51 is rotatably journalled (for example, horizontally) by a first bearing such that a rotational direction thereof includes a component in the gravitational direction. A second display device 21 that can be visually recognized by the trainee is provided on the foundation part 2.

The second rotating mechanism 6 is provided on a right side of the foundation part 2 as viewed from the trainee. The second rotating mechanism 6 has a second handle 4 to be gripped by a trainee's right hand and rotationally operated, and a second rotating shaft 61 having one end coupled to the second handle 4. The second rotating shaft 61 is rotatably journalled (for example, horizontally) by a second bearing such that a rotational direction thereof includes the component in the gravitational direction.

In the upper-limb rehabilitation assisting device 1, the trainee rotationally operates the first handle 3 for a paralytic-limb-side left arm and the second handle 4 for a healthy-limb-side right arm in cooperation. In this way, both the arms of the healthy limb and the paralytic limb are exercised in cooperation. Moreover, myoelectricity of the paralytic limb easily occurs, and consequently, recovery of the paralytic limb can be expedited. An upper-limb rehabilitation assisting device 1 related to the first embodiment performs a so-called neuro-rehabilitation in which the properties of the nerve structure of a brain as described above are taken into consideration.

The foundation part 2 is provided with a lifting and lowering mechanism 7 that lifts and lowers the foundation part 2. The lifting and lowering mechanism 7 is provided with, for example, a lifting handle, and the foundation part 2 can be adjusted to an arbitrary height by rotating the lifting handle.

The height positions of the first and second handles 3, 4 of the first and second rotating mechanisms 5, 6 can be adjusted by lifting and lowering the foundation part 2. Accordingly, for example, since the centers of the first and second handles 3, 4 can be aligned with the height position of a trainee's shoulders, the same motion can be given to even trainees having different physiques, and optimal rehabilitation training can be performed.

The foundation part 2 is provided with a rail part 8 by which the first and second rotating mechanisms 5, 6 are coupled together so as to be slidable in a rightward-leftward direction (longitudinal direction). An inter-axial distance between the first and second rotating shafts 51, 61 of the first and second handles 3, 4 can be arbitrarily adjusted by moving the first and second rotating mechanisms 5, 6 in the rightward-leftward direction along the rail part 8. Accordingly, for example, since the inter-axial distance between the first and second rotating shafts 51, 61 of the first and second handles 3, 4 can be aligned with the breadth of the trainee's shoulders, the same motion can be given to even trainees having different physiques, and optimal rehabilitation training can be performed.

A pair of movable parts 9 that make the first and second handles 3, 4 of the first and second rotating mechanisms 5, 6 movable in the directions of the rotating shafts are provided at both ends of the rail part 8 of the foundation part 2. If external forces are added in the directions of the rotating shafts by the movable parts 9 at the first and second handles 3, 4, the first and second handles 3, 4 move in the directions of the rotating shafts elastically according to the external forces, and if the first and second handles are released from the external forces, the handles return to their original positions. Hence, for example, by moving the first and second handles 3, 4 in the directions of the rotating shafts elastically according to the movement of the trainee's paralytic limb, the paralytic limb can be easily moved.

The first and second rotating shafts 51, 61 of the first and second rotating mechanisms 5, 6 are configured such that the directions thereof can be changed between the horizontal direction and the gravitational direction. Accordingly, the angles of the first and second handles 3, 4 can be set to optimal values according to the rehabilitation training.

Both ends of the rail part 8 are fixed to the foundation part 2 via a pair of hinge parts. The rail part 8 rocks via the hinge parts within a range of 0° degree (the first and second handles 3, 4 extend in the vertical direction and the first and second rotating shafts 51, 61 extend in the horizontal direction) to 90° (the first and second handles 3, 4 extend in the horizontal direction and the first and second rotating shafts 51, 61 extend in the gravitational direction). In addition, although the rail part 8 is configured to be fixed via the hinge parts at two positions of 0° and 90°, the embodiment is not limited to this. For example, the rail part 8 may be configured such that the rail part can be fixed at an intermediate position of 45° or arbitrary positions of 10°, 15°, 30°, and the like via the hinge parts.

The first and second handles 3, 4, for example, are fitted to key parts formed in the first and second rotating shafts 51, 61, and are coupled together with locking screws in end surfaces of the shafts. This locking screws are formed in a shape such that the locking screws can be simply operated with hands without using a tool. Hence, the first and second handles 3, 4 can be easily detached from and attached to the first and second rotating shafts 51, 61. Additionally, the first and second handles 3, 4 having a plurality of different diameters are prepared in advance. The first and second handles 3, 4 with optimal diameters can be selected according to the rehabilitation training, and be attached to the first and second rotating shafts 51, 61.

Figure 2:
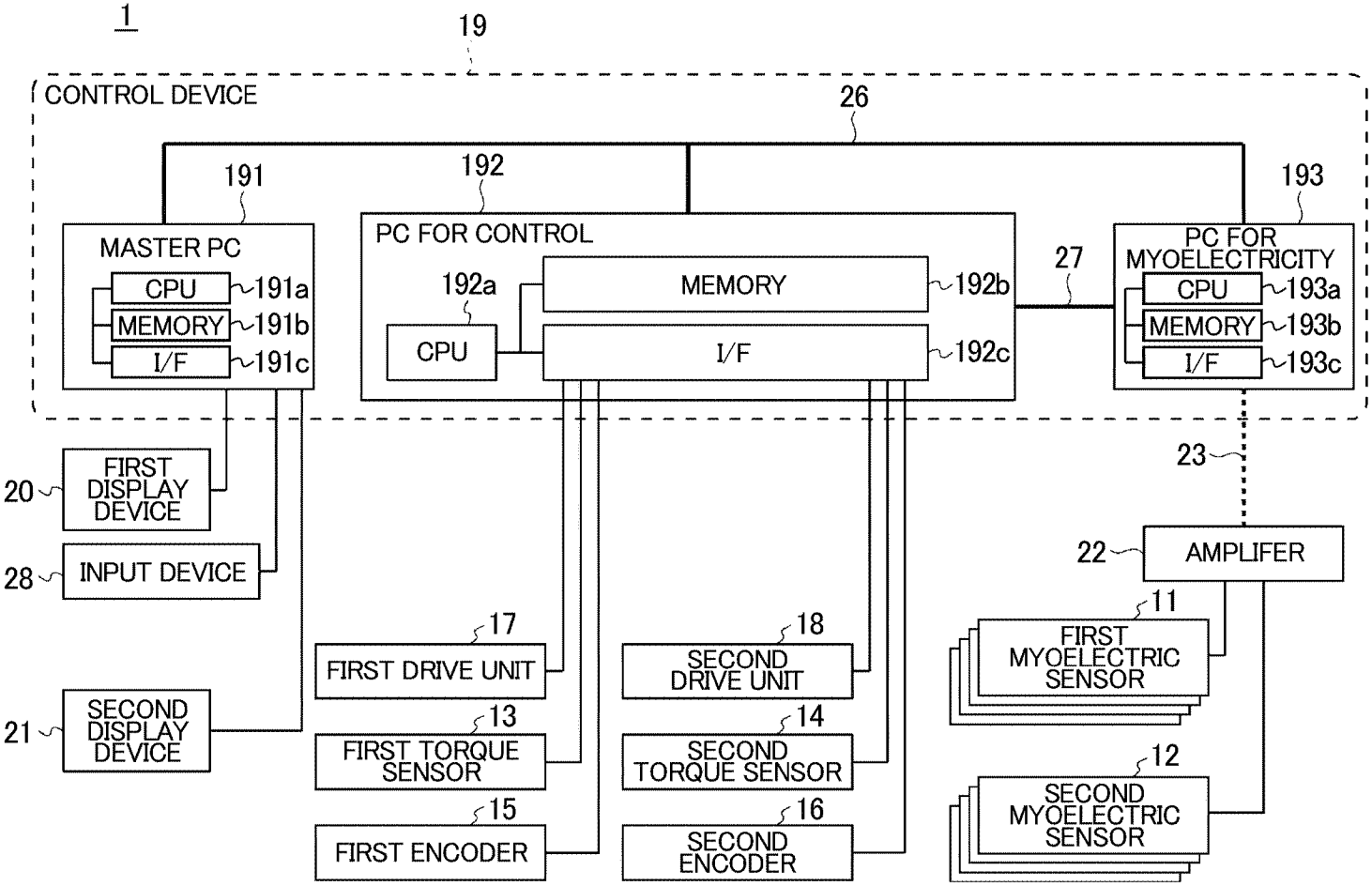
FIG. 2 is a block diagram illustrating a schematic system configuration of the upper-limb rehabilitation assisting device related to the first embodiment.

FIG. 2 is a block diagram illustrating a schematic system configuration of the upper-limb rehabilitation assisting device related to the first embodiment of the disclosure. The upper-limb rehabilitation assisting device 1 related to a first embodiment includes a first myoelectric sensor 11, a second myoelectric sensor 12, a first torque sensor 13, a second torque sensor 14, a first encoder 15, a second encoder 16, a first drive unit 17, a second drive unit 18, a control device 19, and first and second display devices 20, 21.

The first myoelectric sensor 11 is one specific example of a first biosignal detecting part. The first myoelectric sensor 11 is attached to, for example, a trainee's left arm, and detects a first myopotential of the left arm. The second myoelectric sensor 12 is one specific example of a second biosignal detecting part. The second myoelectric sensor 12 is attached to, for example, a trainee's right arm, and detects a second myopotential of the right arm. The first and second myoelectric sensors 11, 12 are connected to the control device 19 via, for example, an amplifier 22 and a wireless network 23.

The first torque sensor 13 is one specific example of the first torque detecting part. The first torque sensor 13 is provided in the first rotating mechanism 5, and detects a first rotary torque of the first rotating shaft 51. The second torque sensor 14 is one specific example of a second torque detecting part. The second torque sensor 14 is provided in the second rotating mechanism 6, and detects a second rotary torque of the second rotating shaft 61. The first and second torque sensors 13, 14 are connected to the control device 19.

The first encoder 15 is one specific example of a first rotational angle detecting part. The first encoder 15 is provided in the first rotating mechanism 5, and detects a first rotational angle of the first rotating shaft 51. The second encoder 16 is one specific example of a second rotational angle detecting part. The second encoder 16 is provided in the second rotating mechanism 6, and detects a second rotational angle of the second rotating shaft 61. The first and second encoders 15, 16 are connected to the control device 19.

Figure 3:
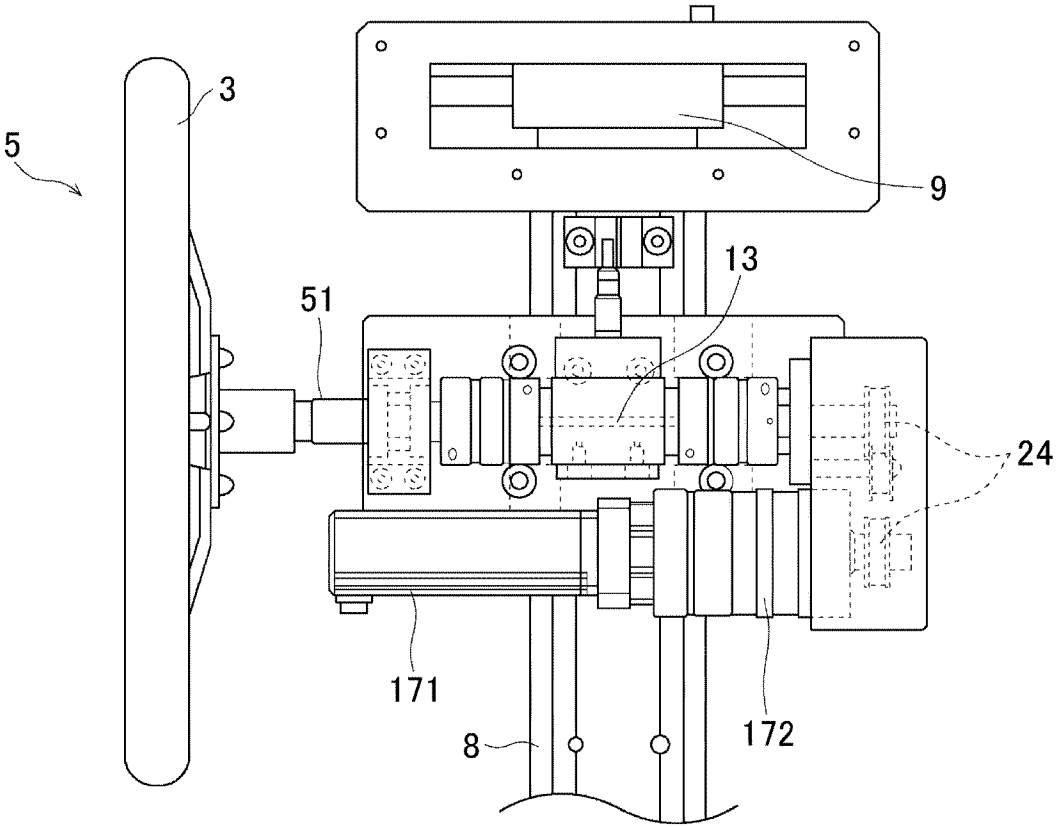
FIG. 3 is a view illustrating a coupled state of first and second drive units, first and second torque sensors, and first and second handles.

The first drive unit 17 is one specific example of a first drive part. The first drive unit 17 is provided in the first rotating mechanism 5, and drives the first rotating shaft 51. The first drive unit 17 has, for example, a motor 171, and a speed reducer 172 coupled to the motor 171 (FIG. 3).

The motor 171 and the speed reducer 172 of the first drive unit 17, the first torque sensor 13, and the first handle 3 are coupled together in this order. In addition, the speed reducer 172 of the first drive unit 17, and the first torque sensor 13 are coupled together so as to be folded back via a pulley 24. Accordingly, the dimension from the first drive unit 17 to the first handle 3 can be suppressed to be small.

The second drive unit 18 is one specific example of a second drive part. The second drive unit 18 is provided in the second rotating mechanism 6, and drives the second rotating shaft 61. The second drive unit 18 has the same configuration as the above first drive unit 17, and has, for example, a motor 181, and a speed reducer 182 coupled to the motor 181 (FIGS. 1 and 3).

The motor 181 and the speed reducer 182 of the second drive unit 18, the second torque sensor 14, and the second handle 4 are coupled together in this order. In addition, the speed reducer 182 of the second drive unit 18, and the second torque sensor 14 are coupled together so as to be folded back via a pulley 25. Accordingly, the dimension from the second drive unit 18 to the second handle 4 can be suppressed to be small. The first and second drive units 17, 18 are connected to the control device 19.

The control device 19 is one specific example of a control part. The control device 19 has a master personal computer (PC) 191, a PC 192 for control, and a PC 193 for myoelectricity. The master PC 191, the PC 192 for control, and the PC 193 for myoelectricity are mutually connected via a communication network 26. The PC 192 for control and the PC 193 for myoelectricity may be mutually connected even by a dedicated line 27 in order to reliably perform data transfer. The master PC 191, the PC 192 for control, and the PC 193 for myoelectricity may be integrally configured as one PC.

In addition, the master PC 191, the PC 192 for control, and the PC 193 for myoelectricity are respectively configured with hardware with a microcomputer as a center. The microcomputer consists of, for example, central processing units (CPU) 191*a*, 192*a*, 193*a* that perform calculation processing or the like, calculation programs executed by the CPUs 191*a*, 192*a*, 193*a*, memories 191*b*, 192*b*, 193*b* consisting of a read only memory (ROM) and a random access memory (RAM) in which control programs or the like are stored, interface parts (I/F) 191*c*, 192*c*, 193*c* that perform the input/output of signals into/from the outside, and the like. The CPUs 191*a*, 192*a*, 193*a*, the memories 191*b*, 192*b*, 193*b*, and the interface parts 191*c*, 192*c*, 193*c* are mutually connected via data buses or the like.

The PC 192 for control performs control of the first and second drive units 17, 18 on the basis of the first and second rotary torques from the first and second torque sensors 13, 14 and the first and second rotational angles from the first and second encoders 15, 16. The PC 193 for myoelectricity performs calculation processing on the basis of the first and second myopotentials from the first myoelectric sensor 11 and the second myoelectric sensor 12.

Figure 4:
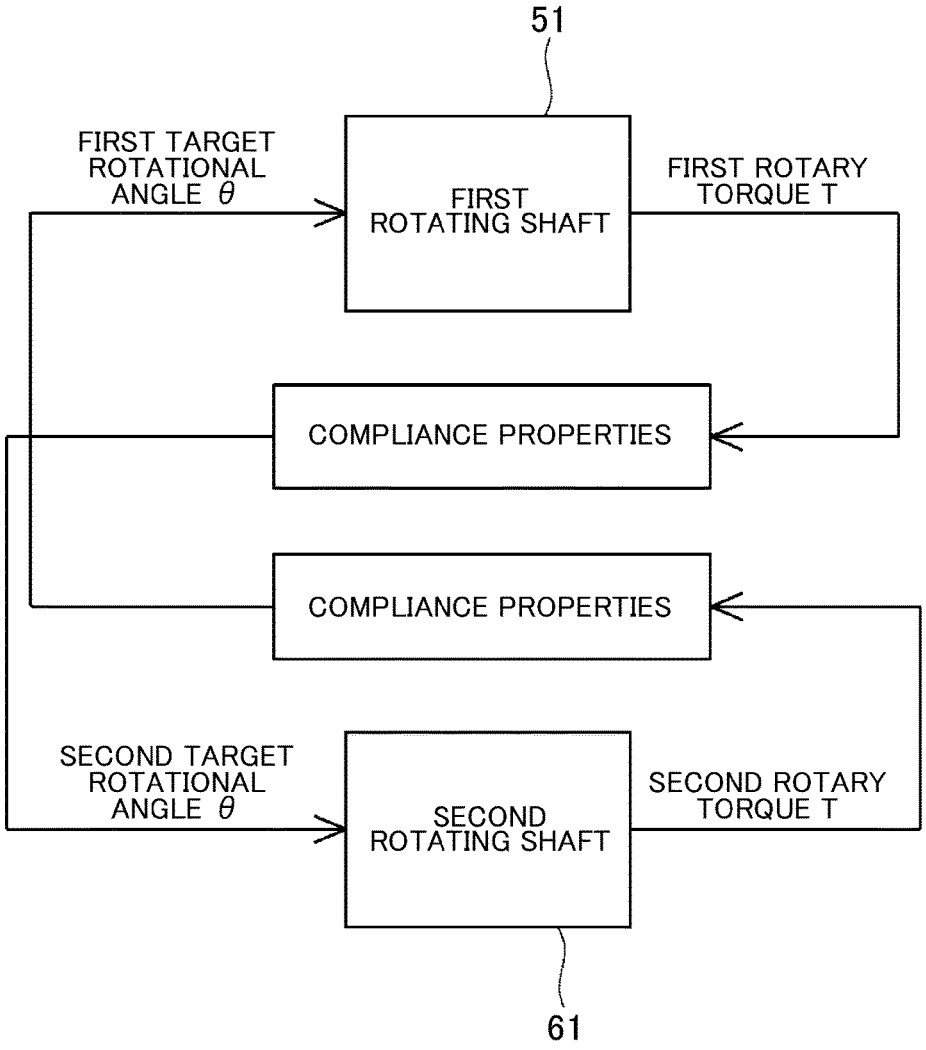
FIG. 4 is a view illustrating a method for controlling the positions of first and second rotating shafts.

The PC 192 for control calculates a second target rotational angle of the second rotating shaft 61 that gives compliance properties, on the basis of the first rotary torque detected by the first torque sensor 13. The PC 192 for control controls the second drive unit 18 such that the second rotational angle detected by the second encoder 16 becomes the calculated second target rotational angle. Simultaneously, the PC 192 for control calculates a first target rotational angle of the first rotating shaft 51 that gives compliance properties, on the basis of the second rotary torque detected by the second torque sensor 14. The PC 192 for control controls the first drive unit 17 such that the first rotational angle detected by the first encoder 15 becomes the calculated first target rotational angle. In this way, the PC 192 for control performs cooperative control of the first and second rotating shafts 51, 61 (FIG. 4). Accordingly, the second handle 4 can be rotated by a healthy-limb-side arm in accordance with the rotation of the first handle 3 by a paralytic-limb-side arm, and cooperative movements of the left and right arms are possible.

A cooperative control system of the first and second rotating shafts 51, 61 related to the first embodiment can be applied to a system in which a weight is attached to a spring. The PC 192 for control calculates the second target rotational angle of the second rotating shaft 61 having the compliance properties, on the basis of the first rotary torque detected by the first torque sensor 13 and an equation of motion regarding the second rotating shaft 61 including a predetermined spring constant. Additionally, the PC 192 for control calculates the first target rotational angle of the first rotating shaft 51 having the compliance properties, on the basis of the second rotary torque detected by the second torque sensor 14 and an equation of motion regarding the first rotating shaft 51 including a predetermined spring constant.

The PC 192 for control calculates, the first and second target rotational angles θ having compliance properties, for example, using the following Expression (2). In addition, in the following Expression (1) and Expression (2), T is the first and second rotary torques and I is a mode mass and r is a damping ratio. The following Expression (1) and Expression (2) are relational expressions of the first and second rotary torques including a predetermined spring constant k and the rotational angles of the first and second rotating shafts. The following Expression (2) can be derived by solving the following Expression (1) with respect to θ.

$$T=I\ddot{\theta}+r\dot{\theta}+k\theta \quad \text{[Expression 1]}$$

$$\theta=f(T) \quad \text{[Expression 2]}$$

In addition, in the above description, the first handle 3 is rotationally operated by the paralytic-limb-side arm and the second handle 4 is rotationally operated by the healthy-limb-side arm. However, the embodiment is not limited to this. The first handle 3 may be rotationally operated by the healthy-limb-side arm, and the second handle 4 may be rotationally operated by the paralytic-limb-side arm.

Meanwhile, the functions that have lost due to apoplexy or the like may be recovered when surroundings of damaged sites of the brain or other sites cover the functions. Therefore, it is important for a patient to carry out the rehabilitation training with the intention of "moving the paralytic limb", and a recovery effect may not appear even if the paralytic limb is not moved without this intention. Hence, if the paralytic-limb-side arm comes to move to some extent except for a case where the paralytic-limb-side arm is completely paralytic, it is preferable to move this paralytic-limb-side arm more actively. However, the movement of the paralytic-limb-side arm depends on the movement of the healthy-limb-side arm, and it may become difficult to move the paralytic-limb-side arm actively.

In contrast, in the upper-limb rehabilitation assisting device 1 related to the present embodiment, the degree of similarity between the first myopotential of the paralytic-limb-side arm detected by the first myoelectric sensor 11 and the second myopotential of the healthy-limb-side arm detected by the second myoelectric sensor 12 is calculated, and the torques of the first and second drive units 17, 18 at the time of the cooperative control of the first and second rotating shafts 51, 61 are reduced as the calculated degree of similarity increases. Accordingly, since an assisting force for the rotational movement of the paralytic-limb-side arm can be adjusted according to the degree of paralysis of the paralytic-limb-side arm, the paralytic-limb-side arm can be actively and easily moved.

The PC 193 for myoelectricity calculates, for example, a correlation coefficient (0 to 1) between the first myopotential of the paralytic-limb-side arm detected by the first myoelectric sensor 11 and the second myopotential of the healthy-limb-side arm detected by the second myoelectric sensor 12, as the degree of similarity. Since the movements of the left and right arms become symmetrical in a case where the left and right arms are healthy, the correlation coefficient has a value near 1. On the other hand, since the movements of the left and right arms does not become symmetrical in a case where one arm is paralyzed, the correlation coefficient has a value smaller than 1. The movement of the paralytic-limb-side arm approaches the movement of the healthy-limb-side arm as the paralytic-limb-side arm is recovered. That is, as the paralytic-limb-side arm is recovered, the movement of the paralytic-limb-side arm and the movement of the healthy-limb-side arm approach each other symmetrically, and the correlation coefficient (the degree of similarity) increases.

The PC 192 for control performs the control of reducing the torques of the first and second drive units 17, 18 at the time of the cooperative control of the first and second rotating shafts 51, 61 as the degree of similarity calculated by the PC 193 for myoelectricity increases. Accordingly, as the paralytic-limb-side arm is recovered and the degree of similarity increases, the torques of the first and second drive units 17, 18 at the time of the cooperative control of the first and second rotating shafts 51, 61 decreases, and the assisting force for the rotational movement of the paralytic-limb-side arm decreases.

For example, the PC 192 for control reduces the spring constant k of the above Expression (1), thereby reducing the torques of the first and second drive units 17, 18 at the time of the cooperative control of the first and second rotating shafts 51, 61 and reducing the assisting force for the rotational movement of the paralytic-limb-side arm, as the degree of similarity calculated by the PC 193 for myoelectricity increases. In this way, the assisting force for the rotational movement of the paralytic-limb-side arm is reduced as the paralytic-limb-side arm is recovered and the degree of paralysis becomes low. Hence, it becomes easy to move the paralytic-limb-side arm, and the paralytic-limb-side arm can be gradually and actively moved.

In addition, if the first and second drive units 17, 18 are configured such that the torques thereof are increased with respect to the rotational movement on the paralytic limb side as a correlation coefficient increases, an "anti-assisting force" of bringing about a control in a direction opposite to that of a normal assisting force is generated. Thus, the PC 192 for control of the upper-limb rehabilitation assisting device 1 may control the torques of the first and second drive units 17, 18 so as to increase the anti-assisting force for the rotational movement of the paralytic-limb-side arm as the above calculated degree of similarity increases.

The master PC 193 performs the control of the PC 192 for control and the control of the first and second display devices 20, 21. The first display device 20 for a training manager, the second display device 21 for a trainee, and input devices (a keyboard, a mouse, and the like) 28 are connected to the master PC 193. The first and second display devices 20, 21 are liquid crystal display devices, organic electroluminescent display devices, or the like. The master PC 193 performs execution or stop of the control programs within the PC 192 for control. The first and second display devices 20, 21 display, for example, the effect indicators (the degree of similarity, myoelectric waveforms, the degree of recovery, and the like) of the rehabilitation training, and model movements at the time of the rehabilitation training, according to control signals from the master PC 193.

Figure 5:
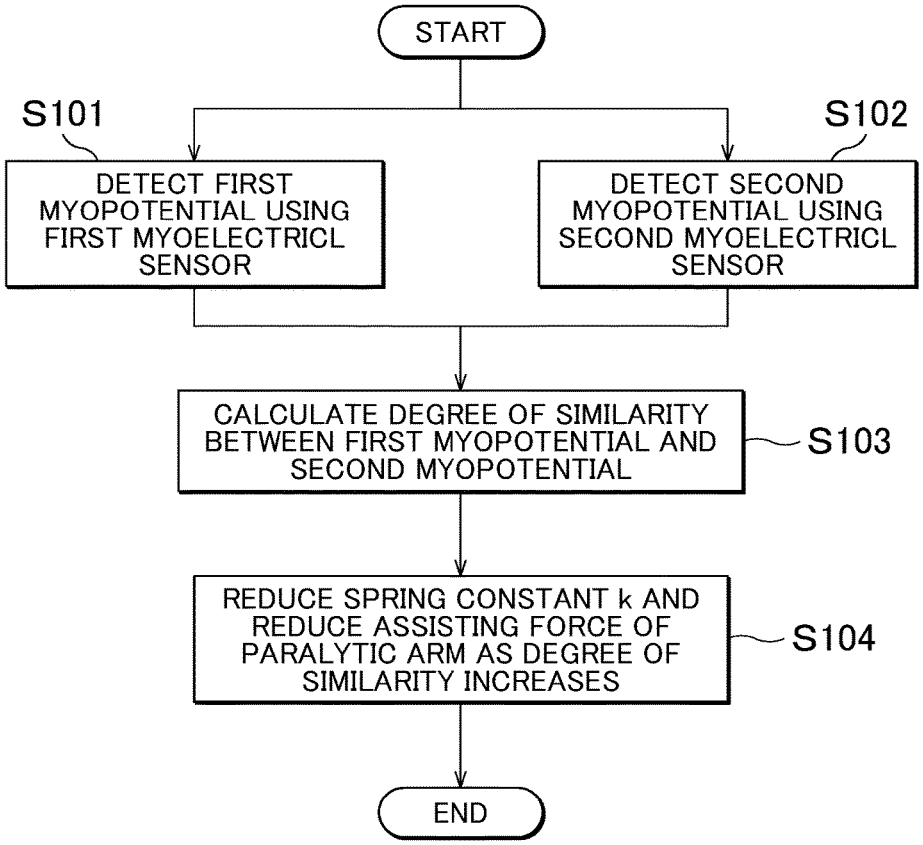
FIG. 5 is a flowchart illustrating a method for controlling the upper-limb rehabilitation assisting device related to the first embodiment.

FIG. 5 is a flowchart illustrating a method for controlling the upper-limb rehabilitation assisting device related to the first embodiment. The first myoelectric sensor 11 detects the first myopotential of the trainee's left arm (Step S101). Simultaneously, the second myoelectric sensor 12 detects the second myopotential of the trainee's right arm (Step S102). The PC 193 for myoelectricity of the control device 19 calculates as the degree of similarity between the first myopotential detected by the first myoelectric sensor 11 and the second myopotential detected by the second myoelectric sensor 12 (Step S103). The PC 192 for control of the control device 19 reduces the predetermined spring constant k of the above Expression (1), thereby reducing the torques of the first and second drive units 17, 18 at the time of the cooperative control of the first and second rotating shafts 51, 61 and reducing the assisting force for the rotational movement of the paralytic-limb-side arm, as the degree of similarity calculated by the PC 193 for myoelectricity increases (Step S104). The master PC 193 of the control device 19 displays the effect indicators (the degree of similarity, myoelectric waveforms, the degree of recovery) of the rehabilitation training on the second display device 21 (Step S105). The trainee can raise the motivation of the rehabilitation training and can expedite recovery, by viewing the effect indicators of this rehabilitation training.

As described above, in the upper-limb rehabilitation assisting device 1 related to the present embodiment, the degree of similarity between the first myopotential of the paralytic-limb-side arm detected by the first myoelectric sensor 11 and the second myopotential of the healthy-limb-side arm detected by the second myoelectric sensor 12 is calculated, and the torques of the first and second drive units 17, 18 at the time of the cooperative control of the first and second rotating shafts 51, 61 are reduced as the calculated degree of similarity increases. Accordingly, the assisting force for the rotational movement of the paralytic-limb-side arm can be reduced as the paralytic-limb-side arm is recovered and the degree of paralysis becomes low. That is, since the assisting force for the rotational movement of the paralytic-limb-side arm can be adjusted according to the degree of paralysis of the paralytic-limb-side arm, the paralytic-limb-side arm can be actively and easily moved.

Second Embodiment

Figure 6:
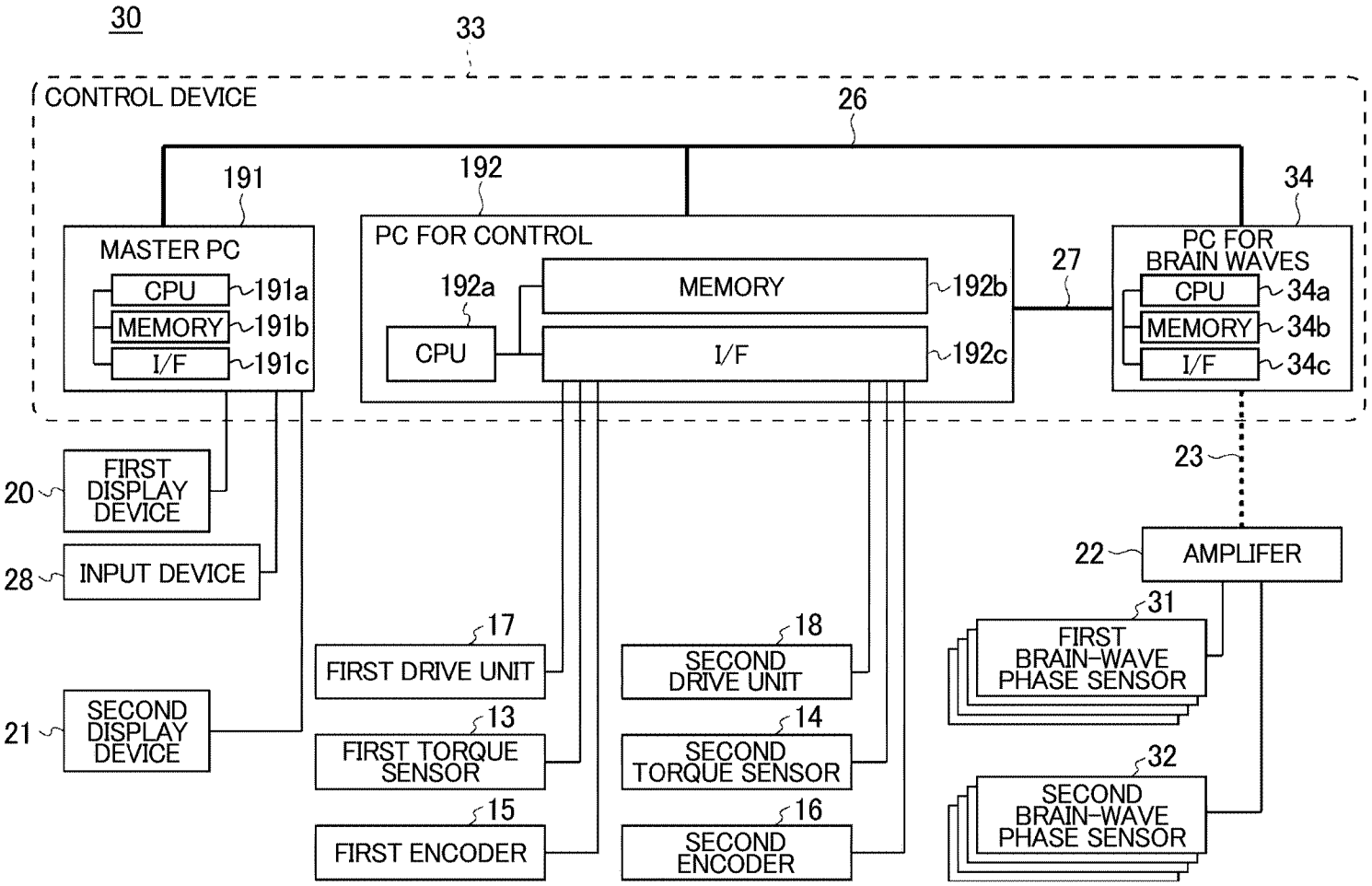
FIG. 6 is a block diagram illustrating a schematic system configuration of an upper-limb rehabilitation assisting device related to a second embodiment.

FIG. 6 is a block diagram illustrating a schematic system configuration of an upper-limb rehabilitation assisting device related to a second embodiment of the disclosure. An upper-limb rehabilitation assisting device 30 related to a second embodiment includes first and second brain-wave phase sensors 31, 32 instead of the first and second myoelectric sensors 11, 12 of the upper-limb rehabilitation assisting device related to the above first embodiment. A control device 33 related to the second embodiment has a PC 34 for brain waves instead of the PC 193 for myoelectricity of the control device 19 related to the first embodiment.

The first brain-wave phase sensor 31 is one specific example of the first biosignal detecting part. The first brain-wave phase sensor 31 is provided in a trainee's head, and detects a first brain-wave signal from the vicinity of a motor area on a brain hemisphere corresponding to a paralytic side of the trainee. The second brain-wave phase sensor 32 is one specific example of the second biosignal detecting part. The second brain-wave phase sensor 32 is provided in the trainee's head, and detects a second brain-wave signal from the vicinity of a motor area on a brain hemisphere corresponding to a healthy side of the trainee.

The PC 34 for brain waves, for example, specifies a first instantaneous phase from the first brain-wave signal on the paralytic limb side detected by the first brain-wave phase sensor 31, and specifies a second instantaneous phase from the second brain-wave signal on the healthy limb side detected by the second brain-wave phase sensor 32. The PC 34 for brain waves calculates the degree of synchronization (the degree of phase synchronization) between the specified first instantaneous phase and the specified second instantaneous phase. That is, as the paralytic-limb-side arm is recovered, the movement of the paralytic-limb-side arm and the movement of the healthy-limb-side arm approach each other symmetrically, and the degree of phase synchronization increases.

The PC 192 for control performs the control of reducing the torques of the first and second drive units 17, 18 at the time of the cooperative control of the first and second rotating shafts 51, 61 as the degree of phase synchronization calculated by the PC 34 for brain waves increases. Accordingly, as the paralytic-limb-side arm is recovered and the degree of phase synchronization increases, the torques of the first and second drive units 17, 18 at the time of the cooperative control of the first and second rotating shafts 51, 61 decreases, and the assisting force for the rotational movement of the paralytic-limb-side arm decreases.

For example, as the degree of phase synchronization calculated by the PC 34 for brain waves increases, the PC 192 for control reduces the spring constant k of the above Expression (1), thereby reducing the torques of the first and second drive units 17, 18 at the time of the cooperative control of the first and second rotating shafts 51, 61 and reducing the assisting force for the rotational movement of the paralytic-limb-side arm. In this way, the assisting force for the rotational movement of the paralytic-limb-side arm is reduced as the paralytic-limb-side arm is recovered and the degree of paralysis becomes low. Hence, it becomes easy to move the paralytic-limb-side arm, and the paralytic-limb-side arm can be gradually and actively moved. In addition, the PC 192 for control of the upper-limb rehabilitation assisting device 30 may control the torques of the first and second drive units 17, 18 so as to increase the anti-assisting force for the rotational movement of the paralytic-limb-side arm as the above calculated degree of phase synchronization increases. In the second embodiment, the same parts as those of the above first embodiment will be designated by the same reference signs, and the detailed description thereof will be omitted.

Third Embodiment

The upper-limb rehabilitation assisting device 1 related to the third embodiment of the disclosure calculates a deviation between a track of a target operated by the first handle 3 of the paralytic-limb-side arm, and a predetermined track, in a virtual space, and reduces the assisting force for the rotational movement of the paralytic-limb-side arm as this deviation decreases. In addition, in the second embodiment, for example, the trainee operates the first handle 3 with an arm on the paralytic side such that, in the virtual space, the target automatically moves forward and the target travels on the predetermined track. The control device 19 moves the target with respect to the predetermined track in the virtual space according to the first rotational angle resulting from the first handle 3 detected by the first encoder 15. The control device 19 performs the control of displaying a target position and the predetermined track within the virtual space on a display screen of the second display device 21. The trainee operates the first handle 3 such that the target within the virtual space displayed on the second display device 21 travels on the predetermined track. In addition, in the third embodiment, the same parts as those of the above first embodiment will be designated by the same reference signs, and the detailed description thereof will be omitted.

The control device 19, similar to the above first embodiment, calculates the second target rotational angle of the second rotating shaft 61 that gives compliance properties, on the basis of the first rotary torque detected by the first torque sensor 13. The control device 19 controls the second drive unit 18 such that the second rotational angle detected by the second encoder 16 becomes the calculated second target rotational angle. Simultaneously, the control device 19 calculates the first target rotational angle of the first rotating shaft 51 that gives compliance properties, on the basis of the second rotary torque detected by the second torque sensor 14. The control device 19 controls the first drive unit 17 such that the first rotational angle detected by the first encoder 15 becomes the calculated first target rotational angle. In this way, the control device 19 performs the cooperative control of the first and second rotating shafts 51, 61.

In this case, the control device 19 calculates the deviation between the track of this target calculated on the basis of the first rotational angle detected by the first encoder 15, and the predetermined track. The control device 19 reduces the torques of the first and second drive units 17, 18 at the time of the cooperative control of the first and second rotating shafts 51, 61, thereby reducing the assisting force for the rotational movement of the paralytic-limb-side arm, as this calculated deviation decreases.

As the paralytic-limb-side arm is recovered and the degree of paralysis becomes low, the deviation between the track of the target operated by the first handle 3 of the paralytic-limb-side arm, and the predetermined track becomes small. Hence, the assisting force for the rotational movement of the paralytic-limb-side arm is decreased, it becomes easy to move the paralytic-limb-side arm, and the paralytic-limb-side arm can be gradually and actively moved. That is, since the assisting force for the movement of the paralytic-limb-side arm can be adjusted according to the degree of paralysis of the paralytic-limb-side arm, the paralytic-limb-side arm can be actively and easily moved. For examples, the target is a vehicle.

In addition, in the above description, the first handle 3 is rotationally operated by the paralytic-limb-side arm and the second handle 4 is rotationally operated by the healthy-limb-side arm. However, the embodiment is not limited to this.

The first handle 3 may be rotationally operated by the healthy-limb-side arm, and the second handle 4 may be rotationally operated by the paralytic-limb-side arm. In this case, a configuration in which information on whether not the trainee, a manager, or the like operates any of the first and second handles 3, 4 with the paralytic-limb-side arm is input and set via the master PC 191 of the control device 19 may be adopted.

In addition, the disclosure is not limited to the above embodiments, and can be appropriately changed without departing from the scope of the disclosure.

What is claimed is:

1. An upper-limb rehabilitation assisting device comprising:

a first handle coupled to a first rotating shaft rotatably provided such that a rotational direction includes a component in a gravitational direction and gripped and rotationally operated by a hand on a paralytic limb side of a trainee;

a second handle coupled to a second rotating shaft rotatably provided such that a rotational direction includes the component in the gravitational direction and gripped and rotationally operated by a hand on a healthy limb side of the trainee;

a first biosignal detecting part configured to detect a first biosignal corresponding to the paralytic limb side of the trainee;

a second biosignal detecting part configured to detect a second biosignal corresponding to the healthy limb side of the trainee;

a first drive part configured to drive the first rotating shaft on the paralytic limb side;

a second drive part configured to drive the second rotating shaft on the healthy limb side;

a first torque detecting part configured to detect a first rotary torque of the first rotating shaft on the paralytic limb side;

a second torque detecting part configured to detect a second rotary torque of the second rotating shaft on the healthy limb side;

a first rotational angle detecting part configured to detect a first rotational angle of the first rotating shaft on the paralytic limb side;

a second rotational angle detecting part configured to detect a second rotational angle of the second rotating shaft on the healthy limb side; and a control part configured to perform a cooperative control of the first rotating shaft and the second rotating shaft in which a second target rotational angle of the second rotating shaft is calculated on a basis of the first rotary torque detected by the first torque detecting part and the second drive part is controlled such that the second rotational angle detected by the second rotational angle detecting part becomes the second target rotational angle and in which a first target rotational angle of the first rotating shaft is calculated on a basis of the second rotary torque detected by the second torque detecting part and the first drive part is controlled such that the first rotational angle detected by the first rotational angle detecting part becomes the first target rotational angle, wherein the control part calculates a degree of cooperation between the first biosignal detected by the first biosignal detecting part and the second biosignal detected by the second biosignal detecting part, and controls torques of the first drive part and the second drive part at a time of the cooperative control of the first rotating shaft and the second rotating shaft, based on the degree of cooperation.

2. The upper-limb rehabilitation assisting device according to claim 1, wherein the control part calculates the second target rotational angle of the second rotating shaft based on a first relational expression among the first rotary torque detected by the first torque detecting part and a rotational angle of the second rotating shaft, the first relational expression including a first predetermined spring constant, calculates the first target rotational angle of the first rotating shaft based on a second relational expression among the second rotary torque detected by the second torque detecting part and a rotational angle of the first rotating shaft, the second relational expression including a second predetermined spring constant, and reduces the torques of the first drive part and the second drive part at the time of the cooperative control of the first rotating shaft and the second rotating shaft by reducing the first predetermined spring constant and the second predetermined spring constant.

3. The upper-limb rehabilitation assisting device according to claim 1, wherein the first biosignal detecting part detects a first myoelectricity of an arm on the paralytic side of the trainee as the first biosignal corresponding to the paralytic limb side, wherein the second biosignal detecting part detects a second myoelectricity of an arm on the healthy side of the trainee as the second biosignal corresponding to the healthy limb side, and wherein the control part calculates a degree of similarity between the first myoelectricity detected by the first biosignal detecting part and the second myoelectricity detected by the second biosignal detecting part, and controls the torques of the first drive part and the second drive part at the time of the cooperative control of the first rotating shaft and the second rotating shaft based on the degree of similarity.

4. The upper-limb rehabilitation assisting device according to claim 1, wherein the first biosignal detecting part detects a first brain-wave signal from the vicinity of a motor area on a brain hemisphere corresponding to the paralytic side of the trainee, as the first biosignal corresponding to the paralytic limb side, wherein the second biosignal detecting part detects a second brain-wave signal from the vicinity of a motor area on a brain hemisphere corresponding to the healthy side of the trainee, as the second biosignal corresponding to the healthy limb side, and wherein the control part calculates a degree of phase synchronization between a first instantaneous phase specified from the first brain-wave signal and a second instantaneous phase specified from the second brain-wave signal, and controls the torques of the first drive part and the second drive part at the time of the cooperative control of the first rotating shaft and the second rotating shaft based on the degree of phase synchronization.

5. A method for controlling an upper-limb rehabilitation assisting device including a first handle coupled to a first rotating shaft rotatably provided such that a rotational direction includes a component in the gravitational direction and gripped and rotationally operated by a hand on a paralytic limb side of a trainee, and a second handle coupled to a second rotating shaft rotatably provided such that a rotational direction includes the component in a gravitational direction and gripped and rotationally operated by a hand on a healthy limb side of the trainee, the method comprising:

detecting a first biosignal corresponding to the paralytic limb side of the trainee;

detecting a second biosignal corresponding to the healthy limb side of the trainee;

detecting a first rotary torque of the first rotating shaft on the paralytic limb side;

detecting a second rotary torque of the second rotating shaft on the healthy limb side;

detecting a first rotational angle of the first rotating shaft on the paralytic limb side;

detecting a second rotational angle of the second rotating shaft on the healthy limb side;

performing a cooperative control of the first rotating shaft and the second rotating shaft in which a second target rotational angle of the second rotating shaft is calculated on a basis of the first rotary torque and the second rotating shaft is controlled such that the second rotational angle becomes the second target rotational angle and in which a first target rotational angle of the first rotating shaft is calculated on a basis of the second rotary torque and the first rotating shaft is controlled such that the first rotational angle becomes the first target rotational angle;

calculating a degree of cooperation between the first biosignal and the second biosignal; and controlling drive torques at a time of the cooperative control of the first rotating shaft and the second rotating shaft, based on the degree of cooperation.

6. An upper-limb rehabilitation assisting device comprising:

a first handle coupled to a first rotating shaft rotatably provided such that a rotational direction includes a component in a gravitational direction and gripped and rotationally operated by a hand on a paralytic limb side of a trainee;

a second handle coupled to a second rotating shaft rotatably provided such that a rotational direction includes the component in the gravitational direction and gripped and rotationally operated by a hand on a healthy limb side of the trainee;

a first drive part configured to drive the first rotating shaft on the paralytic limb side;

a second drive part configured to drive the second rotating shaft on the healthy limb side;

a first torque detecting part configured to detect a first rotary torque of the first rotating shaft on the paralytic limb side;

a second torque detecting part configured to detect a second rotary torque of the second rotating shaft on the healthy limb side;

a first rotational angle detecting part configured to detect a first rotational angle of the first rotating shaft on the paralytic limb side;

a second rotational angle detecting part configured to detect a second rotational angle of the second rotating shaft on the healthy limb side; and a control part configured to perform a cooperative control of the first rotating shaft and the second rotating shaft in which a second target rotational angle of the second rotating shaft is calculated on a basis of the first rotary torque detected by the first torque detecting part and the second drive part is controlled such that the second rotational angle detected by the second rotational angle detecting part becomes the second target rotational angle and in which a first target rotational angle of the first rotating shaft is calculated on a basis of the second rotary torque detected by the second torque detecting part and the first drive part is controlled such that the first rotational angle detected by the first rotational angle detecting part becomes the first target rotational angle, wherein the control part moves a target with respect to a predetermined track in a virtual space according to the first rotational angle detected by the first rotational angle detecting part, calculates a deviation between a track of the target calculated on a basis of the first rotational angle, and the predetermined track, and reduces torques of the first drive part and the second drive part at a time of the cooperative control as the deviation decreases.

* * * * *